US005447196A

United States Patent [19]

Roberts

[11] Patent Number: 5,447,196

[45] Date of Patent: Sep. 5, 1995

[54] HYDRAULIC JAR

[76] Inventor: Billy J. Roberts, 5107 Forest Haven, Houston, Tex. 77066

[21] Appl. No.: 187,708

[22] Filed: Jan. 27, 1994

[51] Int. Cl.[6] ..... E21B 31/107; E21B 4/14

[52] U.S. Cl. ..... 166/178; 175/296; 175/321

[58] Field of Search ..... 166/178; 175/296, 299, 175/321

[56] References Cited

U.S. PATENT DOCUMENTS

| | | | |
|---|---|---|---|
| 3,735,827 | 5/1973 | Berryman | 175/296 |
| 3,797,591 | 3/1974 | Berryman | 175/296 |
| 4,109,736 | 8/1978 | Webb et al. . | |
| 4,200,158 | 4/1980 | Perkins | 175/296 X |
| 4,361,195 | 11/1982 | Evans . | |
| 4,456,081 | 6/1984 | Newman . | |
| 4,844,157 | 7/1989 | Taylor | 175/299 X |
| 4,844,183 | 7/1989 | Evans | 175/299 |
| 5,007,479 | 4/1991 | Pleasants et al. . | |
| 5,033,557 | 7/1991 | Askew | 166/178 X |
| 5,086,853 | 2/1992 | Evans . | |
| 5,174,393 | 12/1992 | Roberts et al. . | |
| 5,318,139 | 6/1994 | Evans | 166/178 X |

*Primary Examiner*—Michael Powell Buiz
*Assistant Examiner*—Frank S. Tsay
*Attorney, Agent, or Firm*—Vaden, Eickenroht, Thompson & Feather

[57] ABSTRACT

There is disclosed a double-acting hydraulic jar having upper and lower detent pressure chambers having upper and lower restrictions, respectively, formed on the inner diameter of its outer tubular member and through which upper and lower detent means carried about the outer diameter of the inner tubular member may be moved in order to impart either an up or down jar.

7 Claims, 7 Drawing Sheets

FIG.1F
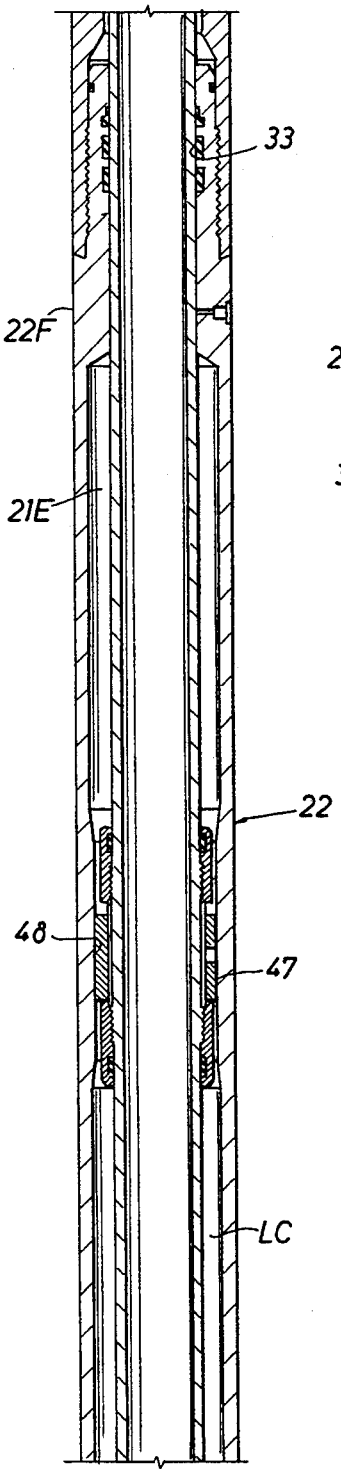
FIG.1G
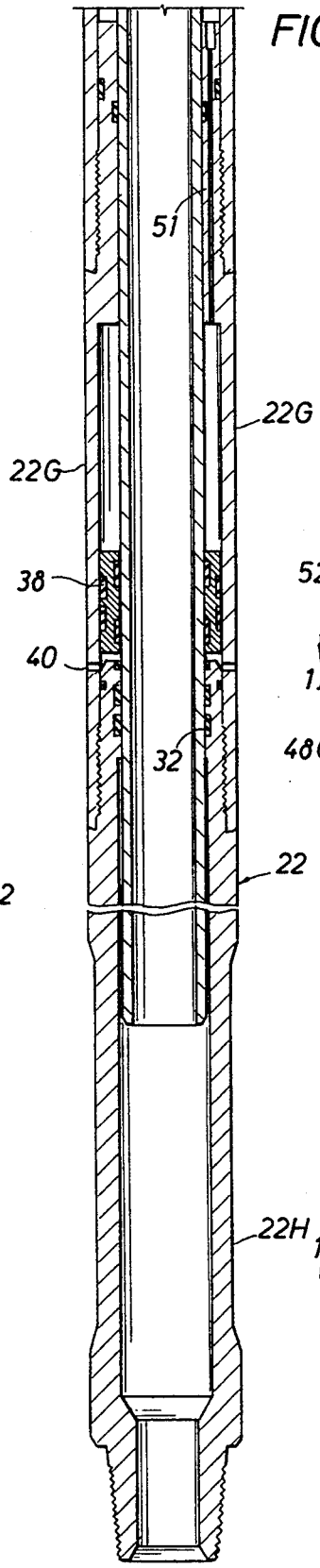
FIG.1H
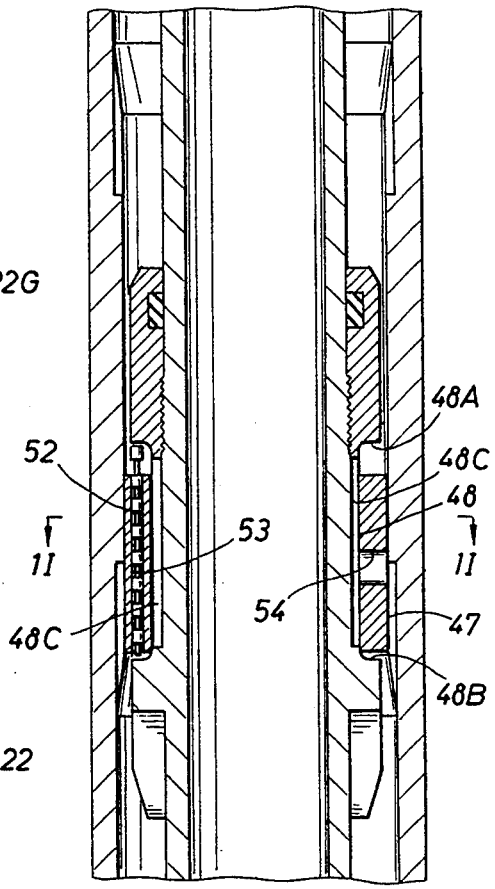
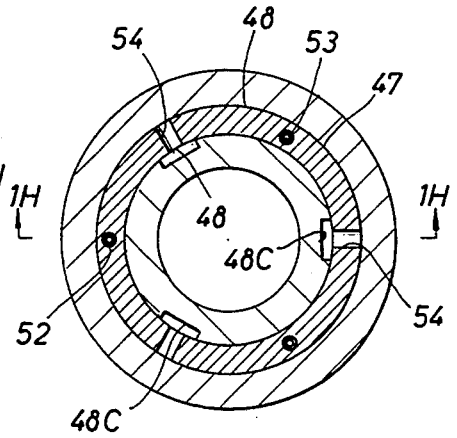
FIG.1I

HYDRAULIC JAR

FIELD OF THE INVENTION

This invention relates generally to a tool for use in imparting a jar to an object stuck in a well bore, and, more particularly, to improvements in a so-called double acting hydraulic jar for imparting up and down jars to the object.

As well known in the art, a conventional hydraulic jar comprises a pair of telescopically arranged, tubular members, one for connection to the object and the other to a pipe string which may be raised and lowered within the well bore. More particularly, the members are circumferentially spaced apart to form an annular space between them with one member having a cylindrical surface which forms a restriction within the space and the other carrying detent means which fits closely within the restriction so as to retard its movement therethrough and thus stretch the pipe string as it is raised, in the case of an up jar, or retard its movement therethrough and thus compress the pipe string as it is lowered, in the case of the down jar. The tubular members also have oppositely facing shoulders which are adapted to engage as the detent means moves out of the restriction so as to impart a jar to the object in the desired direction.

More particularly, the outer member is ported to connect the annulus with the well bore, and a piston is sealably slidable between the members within the space to separate the port from a detent chamber therein in which hydraulic fluid is contained. This, of course, equalizes the fluid pressure within the jar and well fluid in the annulus to facilitate raising and lowering of the jar within the well bore, as well as separating the hydraulic fluid from the well fluid to avoid contamination.

DESCRIPTION OF THE PRIOR ART

U.S. Pat. No. 4,109,736, assigned to the assignee of the present application, shows several embodiments of a double acting hydraulic jar of this type, including one which has enjoyed considerable success in the industry. In this form of the jar, which is illustrated and described in connection with FIGS. 8 to 16 of that patent, there are a pair of detent chambers each having a restriction formed on one member thereof and a pair of detent means each carried by the other member for movement through the restriction in one of the chambers. More particularly, the detent means are so arranged with respect to one another and the restrictions that each may be "short-cocked" in preparation for a subsequent jar.

Thus, assume that the tool has just delivered an upward jar following movement of the upper detent means out of the upper restriction. During this time, of course, the lower detent means has moved through the lower restriction without pressurizing the fluid in the lower hydraulic chamber due to the fact that its detent means is reversed with respect to the upper detent mechanism. If then another upward jar is to be delivered, the tool may be moved into a "short-cocked" position by lowering the upper detent means in the restriction until the weight detector indicates that the lower detent means has begun to move into the lower restriction. Obviously, a reversal of this procedure permits the jar to be moved into a short-cocked position following a down jar.

Also, each detent means of the jar of U.S. Pat. No. 4,109,736 is of simplified but reliable construction in which a detent ring means carried by the inner tubular member has an outer diameter closely slidable within a restriction in the outer tubular member, and an inner diameter disposed about elongate slots or grooves on the inner member. More particularly, the detent ring means is free to move longitudinally with respect to the inner member intermediate shoulders thereabout, and one or more metering pins extend with close tolerance through holes in the detent ring means to engage at their opposite ends with the shoulders. As each ring means moves into its restriction, one end thereof is seated upon a shoulder to prevent flow between it and the slots and thus retard movement of the inner member until the detent ring is moved out of the restriction. Despite these advantages, due to the two detent chambers, among other things, this jar is relatively long and expensive to manufacture.

U.S. Pat. No. 4,456,081 discloses several embodiments of a double-acting, hydraulic jar in which detent means for imparting both up and down jars are contained within a single detent chamber having a single restriction through which the detent means are moved during an up or down jar. Moreover, the detent means are so constructed and arranged as to permit the jar to be "short-cocked" preparatory to repeated up or down jars. That is, the detent means for retarding flow during an up jar is arranged beneath the detent means for retarding flow during a down jar so that following an up jar, it may be moved downwardly a short distance into the restriction before the detent means for retarding flow during a down jar enters the restriction. Conversely, following a down jar, the means for retarding flow during a down jar may be moved upwardly a short distance into the restriction ("short-cocked") before the means for retarding flow during an up jar enters the restriction.

Although this theoretically permits the overall length of the jar to be shortened, at least as compared to the aforementioned jar of U.S. Pat. No. 4,109,736, the detent means are of such construction as to be susceptible to considerable wear and malfunction. Thus, hydraulic fluid in the detent chamber must pass through spring biased check valves, as the detent means move through the restriction, and a portion of the tubular member on which the detent means are mounted forms seals with respect to the restriction as the adjacent detent means are moved therethrough.

U.S. Pat. No. 5,174,393, also assigned to the assignee of the present application, discloses a double-acting jar of this general type which, like the jars of U.S. Pat. Nos. 4,109,736 and 4,456,081, are capable of being "short-cocked," but of such instruction as to have the advantages, without the disadvantages, of each. Thus, each of the detent means comprises detent ring means having flow-limiting means therethrough and carried by one member with one side adapted to move closely through a cylindrical restriction in a detent chamber in the other tubular member and the other side closely surrounding grooves in the one member and vertically reciprocable between positions seated on upper and lower shoulders on the one member to retard the flow of hydraulic fluid therepast as the tool is raised and lowered. However, as compared with the jar of U.S. Pat. No. 4,109,736, the jar has only a single detent chamber with a single restriction formed therein, and the detent ring means is of such construction as to jar upwardly when pulled in one direction through the restriction and jar downwardly when pushed in the other direction through the restriction. Thus, the detent ring means includes a lower annular portion on its outer side which, when the detent ring means is seated on the lower shoulder, restricts flow therepast as it is pulled upwardly through the restriction, and an upper annular portion on its outer side which, when the detent ring means is on the upper shoulder, restricts flow therepast as it is pushed downwardly through the restriction. More particularly, the detent ring means includes means which connects its one side with its other side intermediate the annular portions so that the annular portion last to move out of the restriction is relatively freely movable back into the restriction until the other annular portion enters the restriction to permit the jar to be "short-cocked." In accordance with one embodiment of the jar, the detent ring means comprises a single detent ring having passageway means connecting the one side with the outer side thereof intermediate said annular portions and thus of simple construction and minimum length.

Although the jar of U.S. Pat. No. 5,174,393 thus represents a substantial advance over the jars of U.S. Pat. Nos. 4,109,736 and 4,456,081, and other prior jars of this general type, there is a need in the industry, particularly as wells are drilled to greater depths, to be able to apply greater loads to the jar without exceeding its burst strength. This would enable the operator of the tool to obtain a better balance between burst of the outer housing and collapse of the inner mandrel, which, of course, is crucial because if a jar is over-pulled, it is better for the cylinder to burst than for the mandrel to collapse. Thus, in the latter case, it would be impossible to enter the inner diameter of the pipe string with free point indicators, string shots, etc.

SUMMARY OF THE INVENTION

However, due to the rigid constraints of space within the well bore, it is not practical to merely increase the diameter of the jar and thus the effective pressure-responsive areas in its fluid chambers. Consequently, it is the object of this invention to provide an improved jar of this type which is of such construction as to reduce the pressure in each fluid chamber by fifty percent or more for any given load without increasing its outer diameter or substantially increasing its cost, and, more particularly, to provide such a jar which, similarly to that of U.S. Pat. No. 5,174,393, has detent means of such construction as to permit "short-cocking."

These and other objects are accomplished, in accordance with the illustrated embodiment of the invention, by an hydraulic jar having means sealing between upper, lower and intermediate equal diameter portions of the tubular members, an upper piston ring sealably slidable within the annular space between the tubular members intermediate the upper and intermediate sealing means to form an upper pressure chamber in the space on one end of said upper piston ring which is adapted to be filled with hydraulic fluid, and a lower piston ring sealably slidable with the annular space between the tubular members intermediate the lower and intermediate sealing means to form a lower pressure chamber in the space on one end of said lower piston ring which is adapted to be filled with hydraulic fluid, with the outer tubular member having ports connecting the exterior thereof with the annular space on the other ends of the piston rings, whereby the pressure of hydraulic fluid in the chambers is equal to that outside of the jar.

The first tubular member has an upper cylindrical restriction in the upper chamber and a lower cylindrical restriction in the lower chamber, and upper detent means are carried by the second tubular member within the upper chamber for movement through the upper restriction so as to restrict the flow of hydraulic fluid within said chamber as the second tubular member is raised with the pipe string with respect to the first tubular member and restrict the flow of such fluid within the chamber as the second tubular member is raised with the pipe string respect to the first tubular member. The lower detent means, on the other hand, are carried by the second tubular member within the lower chamber so as to restrict the flow of hydraulic fluid within said chamber simultaneously with the restriction of flow in said upper chamber as the second tubular member is lowered with the pipe string with respect to the first tubular member and restrict the flow of such fluid within the chamber simultaneously with the restrict the flow in said upper chamber as the second tubular member is lowered with the pipe string with respect to said first tubular member. More particularly, means are provided on the tubular members for engaging one another to impart an up jar to the object as the upper and lower detent means are raised upwardly out of the restrictions and for engaging one another to impart a down jar to the object as said upper and lower detent means are lowered through the restrictions. Thus, in accordance with one novel aspect of this invention, the fluid pressure in each chamber is essentially only 50% of what it would otherwise be, so that the load on the jar may be doubled without increasing the risk of damage.

Preferably, the upper and lower detent means includes means by which, following an up jar, they may be moved downward into the restrictions preparatory to imparting another up jar, without restricting the relatively free flow therepast in the opposite direction, and following a down jar, moved upwardly into the restrictions preparatory to imparting another down jar, without restricting the relatively free flow therepast in the opposite direction, whereby, as in the jar of U.S. Pat. No. 5,174,393, the jar may be "short-cocked" following either an up jar or down jar. Thus, the outer tubular member has upper and lower sets of longitudinal grooves formed about its circumference intermediate longitudinally spaced shoulders, and each of the upper and lower detent means comprises detent ring means having one side closely movable through the upper and lower restrictions and the other side surrounding the upper and lower sets of grooves, respectively, for vertical reciprocation with respect to said second member between a first position in which its lower end is seated on a lower shoulder to prevent flow therepast, as a lower annular portion of its other side is pulled upwardly through the restriction, and a second position in which its upper end is seated on the upper shoulder to prevent flow therepast, as an upper annular portion of its other side is pushed downwardly through the restriction. More particularly, each detent ring means includes metering means which permits limited flow therethrough as said annular portions move through said restrictions, and means connecting its one side with its other side intermediate such annular portions so that the annular portion last to move out of the restriction is relatively freely movable back into the restriction until the other annular portion enters the restriction. As in the aforementioned embodiment of the detent ring means of U.S. Pat. No. 5,174,393, the detent ring means comprises a single detent ring having passageway means therein connecting the one side with the outer side thereof intermediate said annular portions, with the passageway means comprising a hole extending through the detent ring to connect with its opposite sides.

As illustrated, the cylindrical restrictions are on the inner diameter of the outer member, and the detent ring means are carried by the inner member. Preferably, a means is provided for adjusting the vertical positions of the shoulders of at least one of the detent means with respect to the length of the tubular member on which the detent ring is carried, so as to insure simultaneous movement of both detent means through their restrictions.

BRIEF DESCRIPTION OF THE DRAWINGS

In the drawings, wherein like reference characters are used throughout to designate like parts:

FIGS. 1A, 1B, 1C, 1D, 1E, 1F, and 1G are longitudinal sectional views of the jar, as the detent rings are being raised upwardly through their restrictions so as to impart an up jar, and showing the parts thereof respectively from the upper end to the lower end of the jar;

FIG. 1H is an enlarged cross-sectional view of a portion of the jar taken along section line 1H—1H shown in FIG. 1I;

FIG. 1I is a cross-sectional view of the portion of the jar shown in FIG. 1H, as seen along broken lines 1I—1I of FIG. 1H;

DESCRIPTION OF THE PREFERRED EMBODIMENT

Figure 1A:
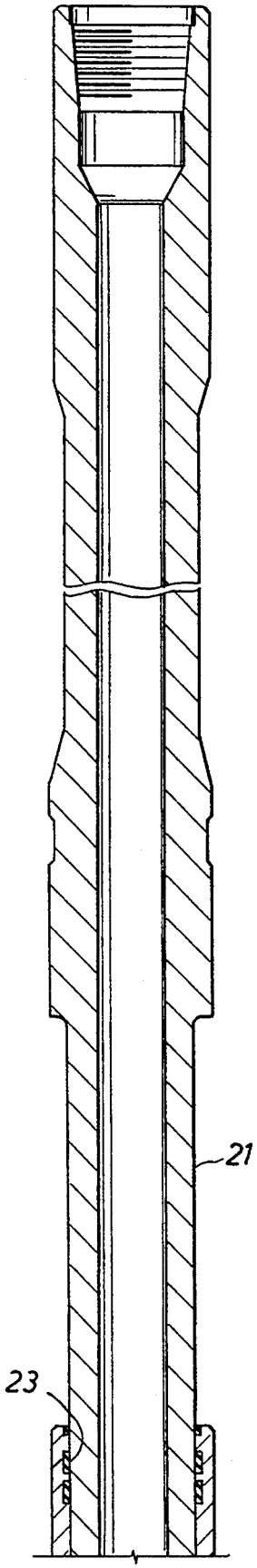
Figure 1B:
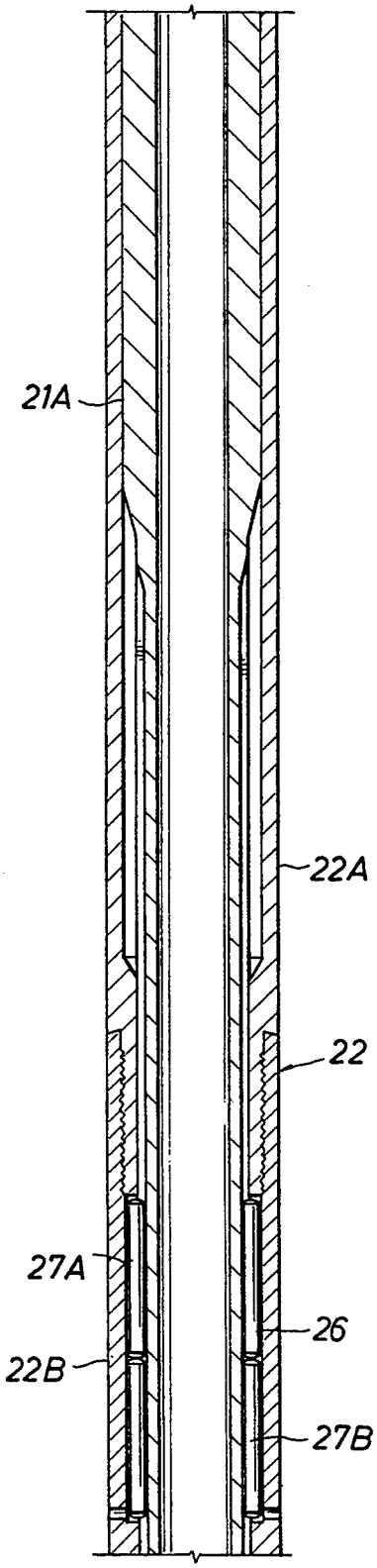

With reference now to the details of the above described drawings, the over-all jar, which is indicated in its entirety by reference character 20, comprises an upper drive and jar portion shown in FIGS. 1A, 1B, 1C, 2A, and 3A, as well as a lower detent portion shown in the remaining figures of the drawings, which are made up of interconnected, telescopically arranged, inner and outer tubular members 21 and 22, respectively, which form an annular space between them. The inner member 21 has a box at the upper end of the upper portion for connection to the lower end of a pipe string (not shown), and the outer member 22 has a pin at the lower end of the lower portion for connection to the box of a tubular object (not shown) stuck in the well bore and adapted to be jarred loose by operation of the jar in the manner to be described.

The inner tubular member includes an uppermost tubular section 21A on the upper end of which the box is formed, a coupling 21B connected to its lower end, and an intermediate tubular section 21C connected to the lower end of the coupling and extending from the drive and jar portion into the detent portion, as will be described to follow. The lower end of another intermediate tubular section 21C is in turn connected by a coupling 21D to a lowermost tubular section 21E.

The outer tubular member 22 includes an uppermost tubular section 22A surrounding the inner tubular sections 21A and 21B and connected at its lower end to a tubular section 22B which is in turn connected to a tubular section 22C. The outer tubular section 22C in turn connects with a tubular section 22D at the connection of the upper drive and jar portion and detent portion to one another. The tubular sections 22D, 22E, 22F, 22G and 22H are in turn connected one below the other with the lowermost section 22H forming the lower end of the jar.

Figure 1C:
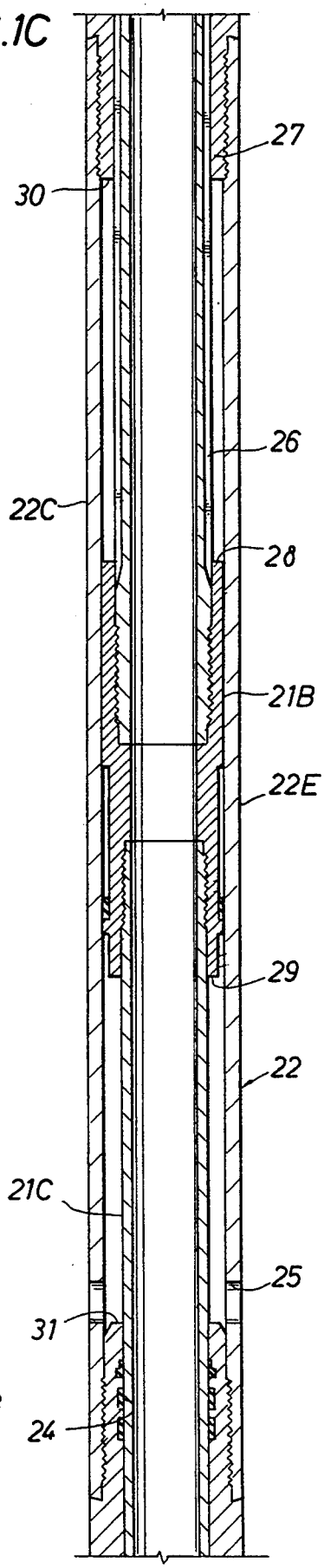

As shown in FIG. 1A, packing rings 23 about the inner diameter of the upper end of section 22A are slidably engaged with section 21A and, as shown in FIG. 1C, packing 24 carried about the inner diameter of section 22D slidably engages the tubular section 21C. A port 25 is formed in the outer tubular section 22C to connect the annular space between the inner and outer members formed between the seal rings 23 and 24 with the exterior of the jar. Elongate pins 26 are received in slots 27A and 27B in the tubular sections 22B and 21A to provide a rotary drive connection between them.

The coupling 21B fits closely within the outer tubular section 22C and has upper and lower shoulders 28 and 29 formed on its opposite ends, with the upper shoulder being disposed opposite a downwardly facing shoulder 30 on the lower end of tubular section 22B, and the downwardly facing shoulder 29 facing oppositely to an upwardly facing shoulder 31 at the upper end of coupling 22D. Thus, as will be described to follow, when tension is applied to the inner tubular member to pull the detent means carried by the inner tubular member upwardly through the restrictions in the outer tubular member, shoulder 28 is freed to move rapidly upwardly against the shoulder 30 to impart an up jar. Conversely, upon downward movement of the detent means through the restrictions, the shoulder 29 is free to move rapidly downwardly to engage the shoulder 31 to impart a downward jar.

The annular space between the tubular members of the upper drive and jar portion is separated from the annular space between the tubular members of the detent portion by packing 24 carried about the inner diameter of a reduced diameter portion of the outer tubular section 22D for sealably engaging the outer diameter of the section 21C of the inner tubular member. The lower annular space within the detent portion is in turn divided into upper and lower annular spaces by means of packing 33 carried about the inner diameter of tubular section 22F for sealing about the tubular section 21E. The lower annular space is in turn closed by packing 32 carried about the inner diameter of outer tubular section 22H for sealing about section 21E. More particularly, the upper packing 24, intermediate packing 33 and lower packing 36 seal about equal diameter portions of the inner tubular member.

An upper piston ring 37 is slidable within the upper annular space intermediate packings 24 and 33 to form an upper chamber UC above the piston ring. A piston ring 38 is sealably slidable within the lower annular space intermediate the packing 33 and 32 to form a lower pressure chamber LC above it. A port 39 is formed in the outer tubular member to connect the outside of the outer tubular member with the annular space below the piston ring 37 such that the pressure in the upper chamber UC above the seal ring is the same as that outside the tubular member. Similarly, a port 40 is formed in the outer tubular member intermediate the packing 32 and the lower side of the piston ring 38 so that the pressure in the lower pressure chamber LC above the ring 38 is the same as that outside the jar. Each of the upper and lower chambers is filled with a hydraulic fluid which is essentially non-compressible.

Upper detent means 45 is carried about the inner tubular member for disposal within the upper pressure chamber UC, and the inner diameter of the outer tubular section 22C has a reduced diameter restriction 46 formed therein through which the detent means 45 is adapted to move as the inner tubular member is raised or lowered. In like fashion, a lower detent means 47 is carried about the inner tubular member within the lower pressure chamber LC for movement through a reduced diameter restriction 48 in the inner diameter of the outer tubular section 22F during this reciprocation of the inner tubular member. As previously described, the detent means are so arranged on the tubular member that each moves through its restriction, in either an up jar or a down jar, simultaneously with the other, so that the jar is loaded uniformly.

As also previously described, when the upper and lower detent means have been raised through their respective restrictions, as shown in FIGS. 2A–2E, the tension on the pipe string causes the upwardly facing shoulder 28 to move rapidly upwardly against the shoulder 30 so as to impart an upward jar. Conversely, when the upper and lower detent means have been moved downwardly through their respective restrictions, as shown in FIGS. 3A–3E, compression in the pipe string causes the downwardly facing shoulder 29 to move rapidly downwardly to engage the upwardly facing shoulder 31 to impart a down jar. Although the upper and lower detent means are shown in FIGS. 1A–1G within their respective restrictions during an up jar, they may instead be above or below the restrictions, in which case the jar would occupy what is known as the "open" position.

The outer tubular member has upper and lower reduced diameter portions 50 and 51 within the upper and lower chambers, respectively, each having a passageway therethrough adapted to be opened and closed by a ball type valve member above a seat within the passageway, with the ball being urged upwardly to open position by means of a coil spring. As more fully set out in the aforementioned U.S. Pat. No. 5,174,393, the disclosure of which is incorporated herein by reference, the spring normally holds the ball unseated with a force less than that developed by the hydraulic fluid in the detent chamber during downward movement of the detent mechanism through the restriction. Consequently, during only the downstroke of the jar, the normally open ball will move downwardly to seat and thus close the passageway, and thereby minimize the loss of hydraulic fluid from the detent chamber which might otherwise occur past the piston below it.

Figure 1D:
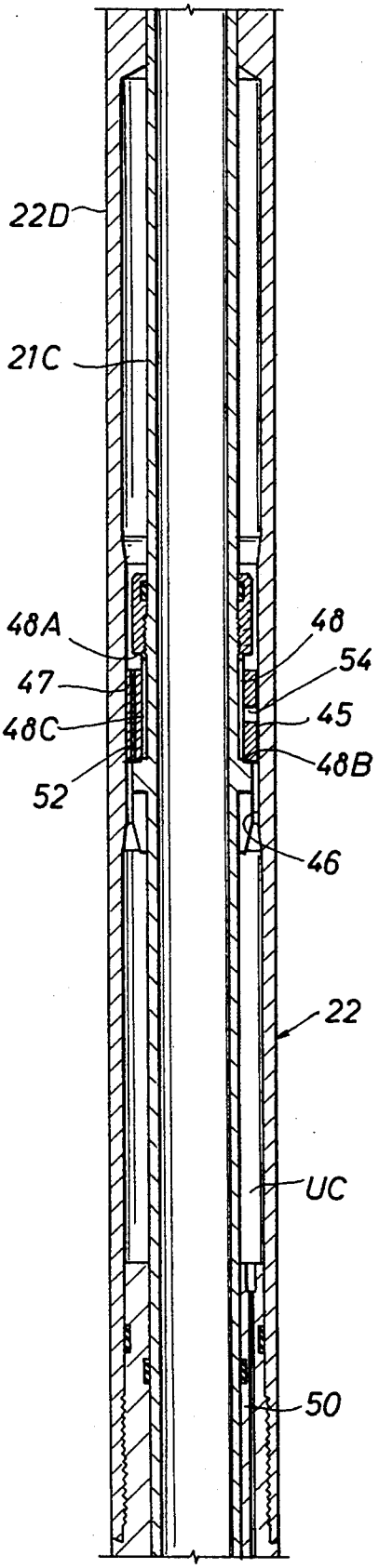
Figure 1E:
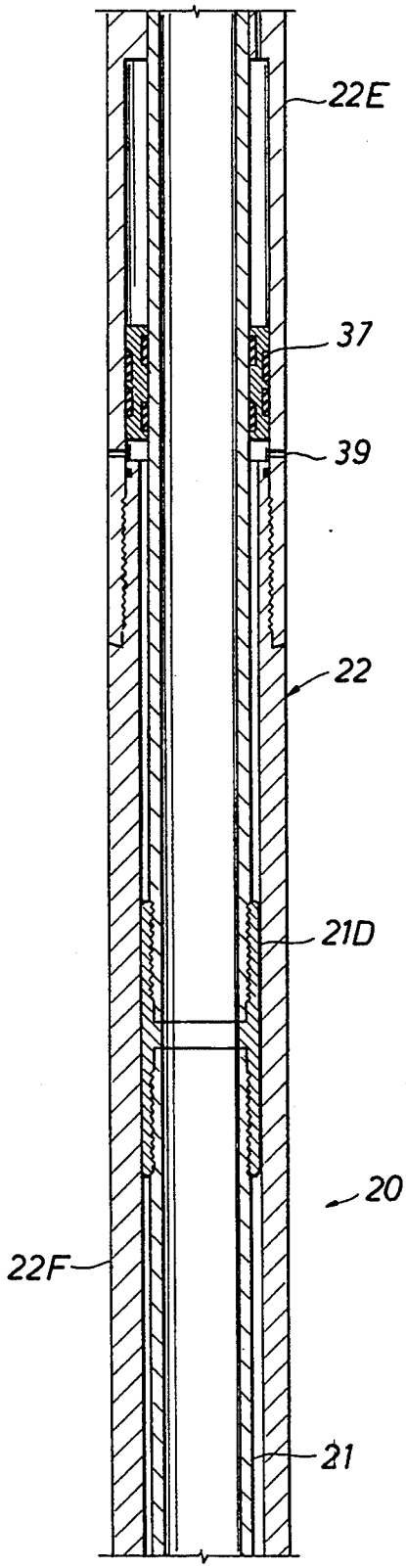
Figure 2A:
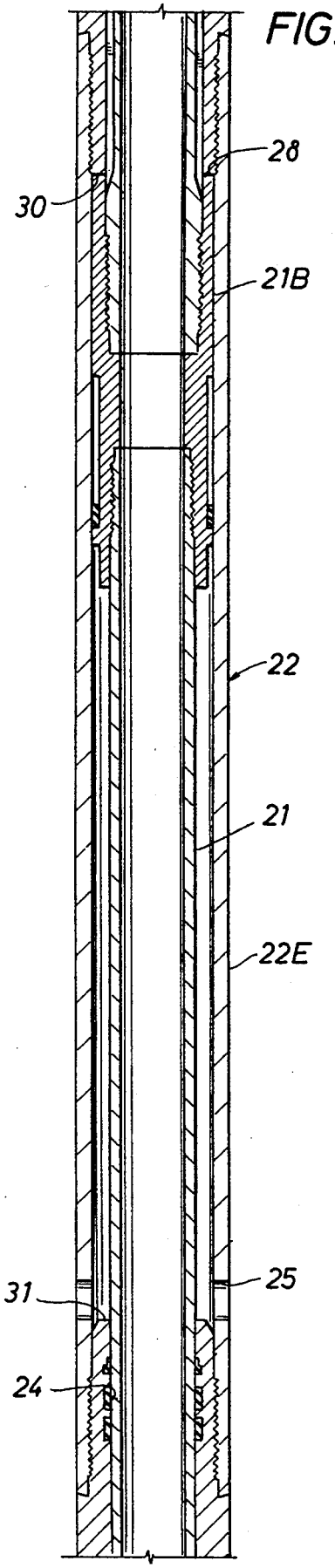
FIGS. 2A, 2B, 2C, 2D, and 2E are similar views of the jar, corresponding to FIGS. 1C, 1D, 1E, 1F, and 1G, respectively, but with parts of the jar shown in their positions following an up jar.
Figure 2B:
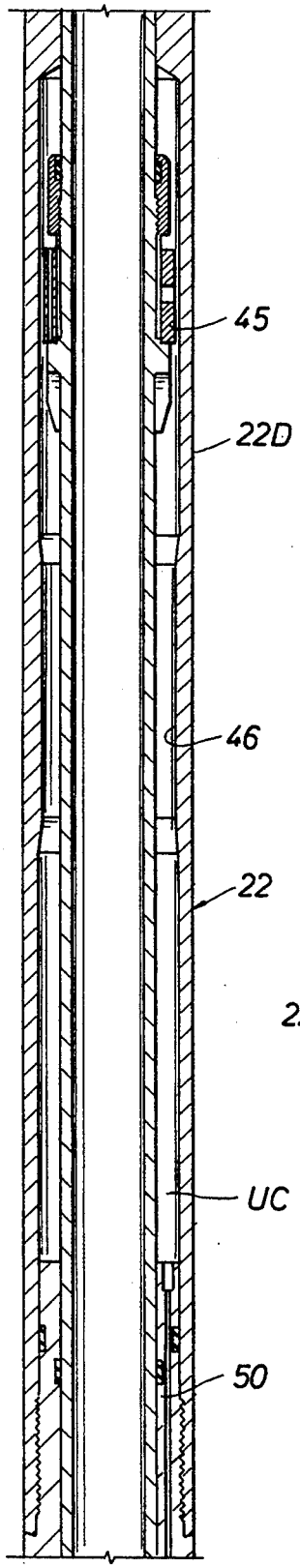
Figure 2C:
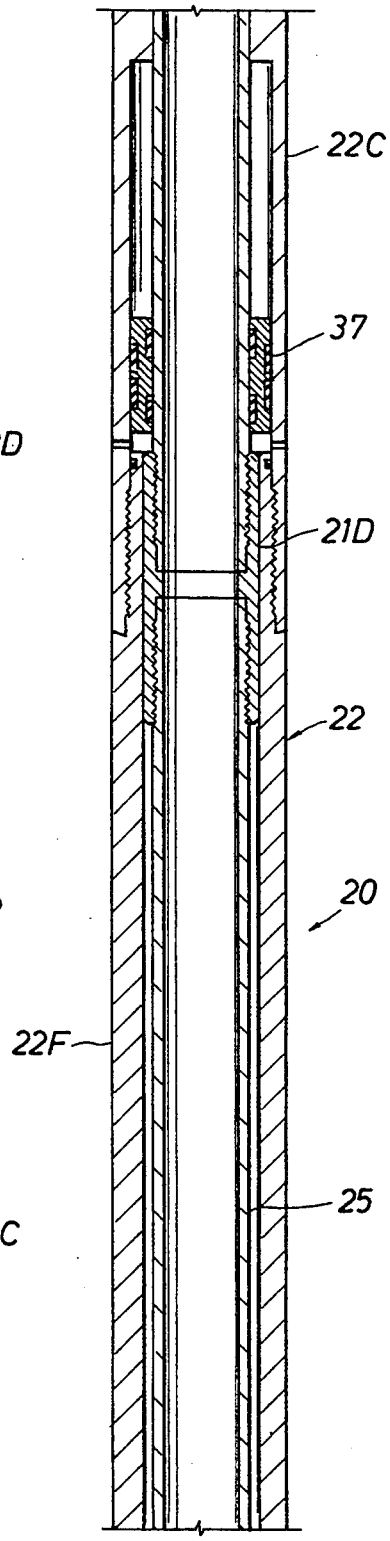
Figure 2D:
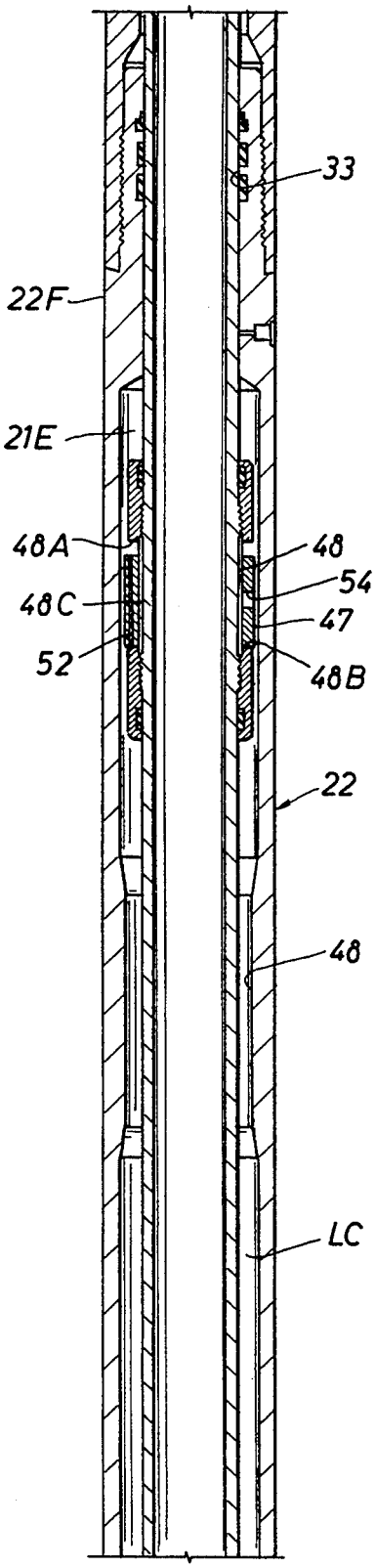
Figure 2E:
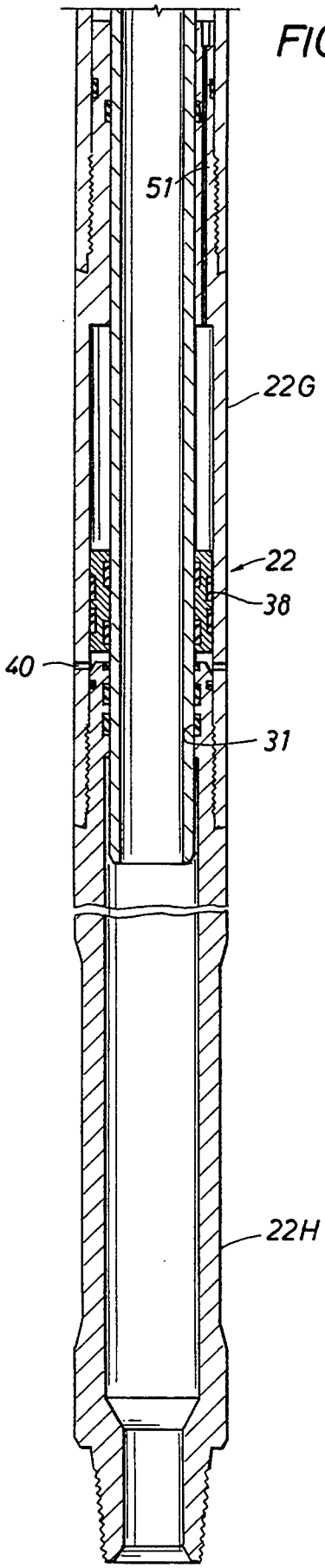
Figure 3A:
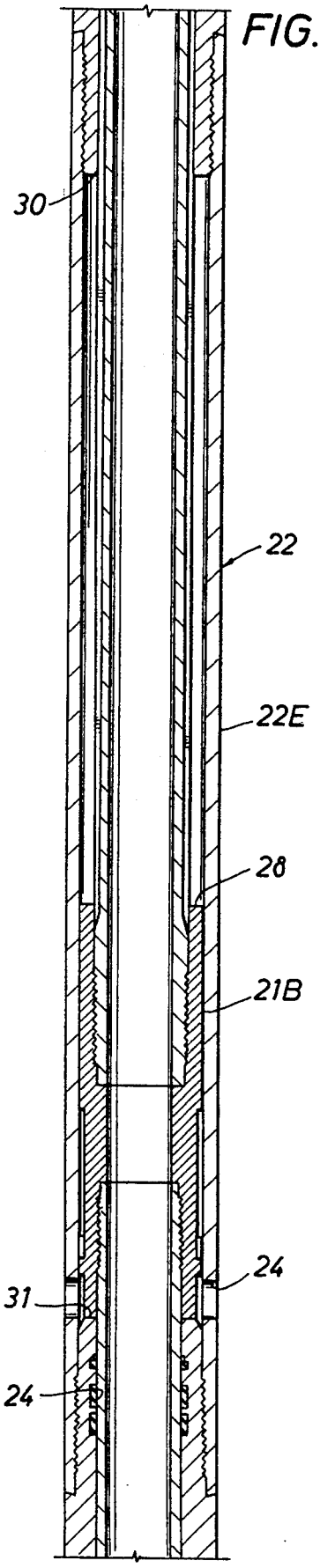
FIGS. 3A, 3B, 3C, 3D, and 3E are longitudinal sectional views of the jar, similar to those of FIGS. 2A, 2B, 2C, 2D, and 2E, respectively, but with the parts of the jar shown in the positions they occupy following a down jar.
Figure 3B:
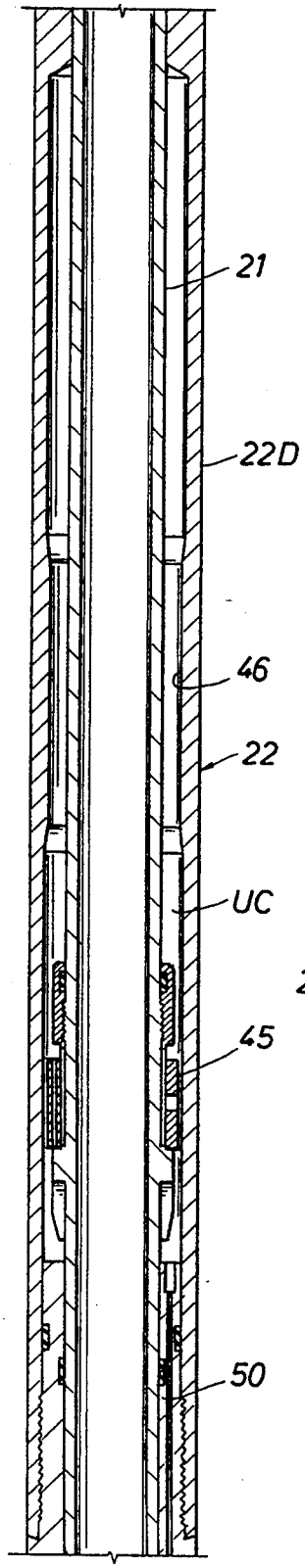
Figure 3C:
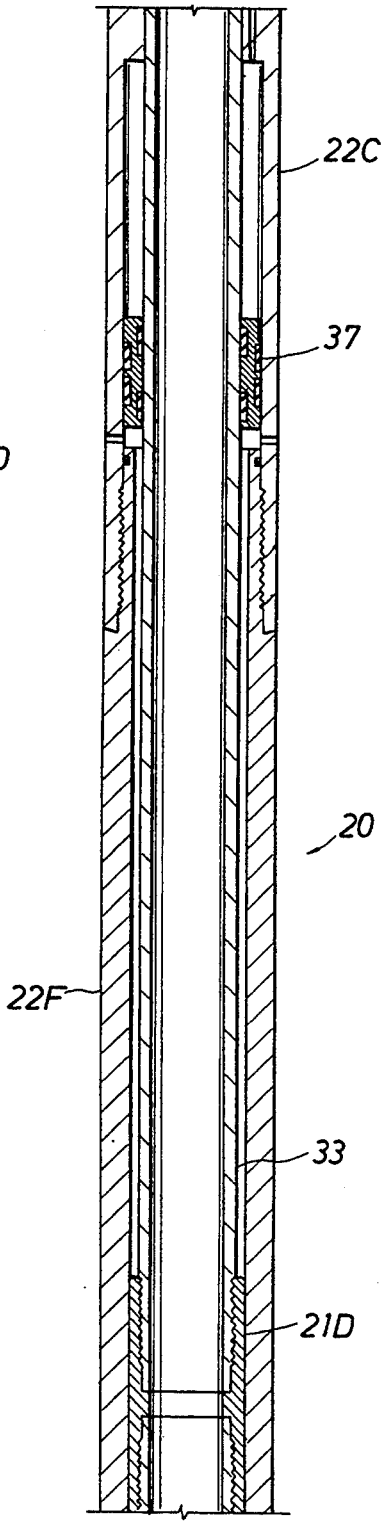
Figure 3D:
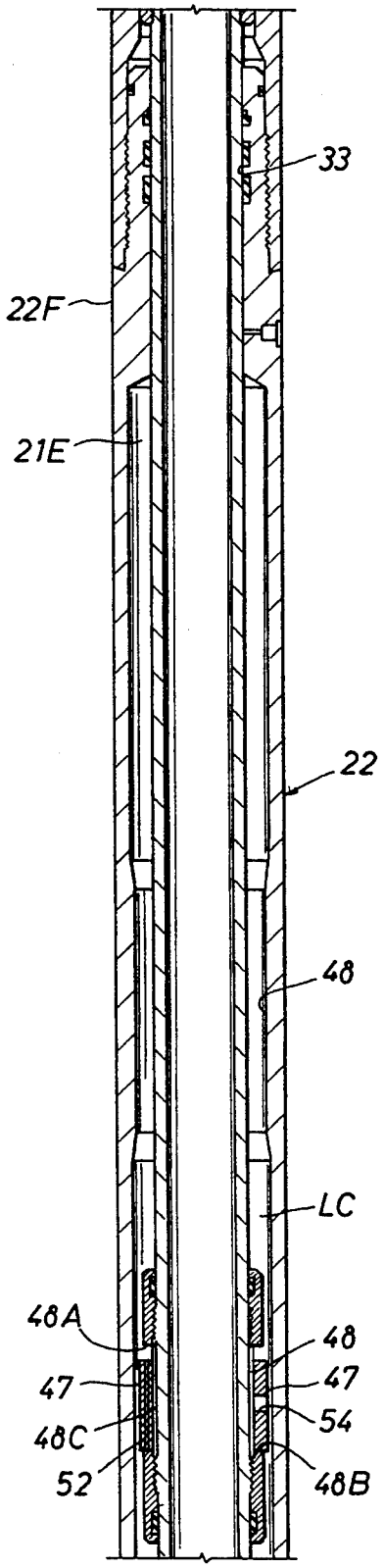
Figure 3E:
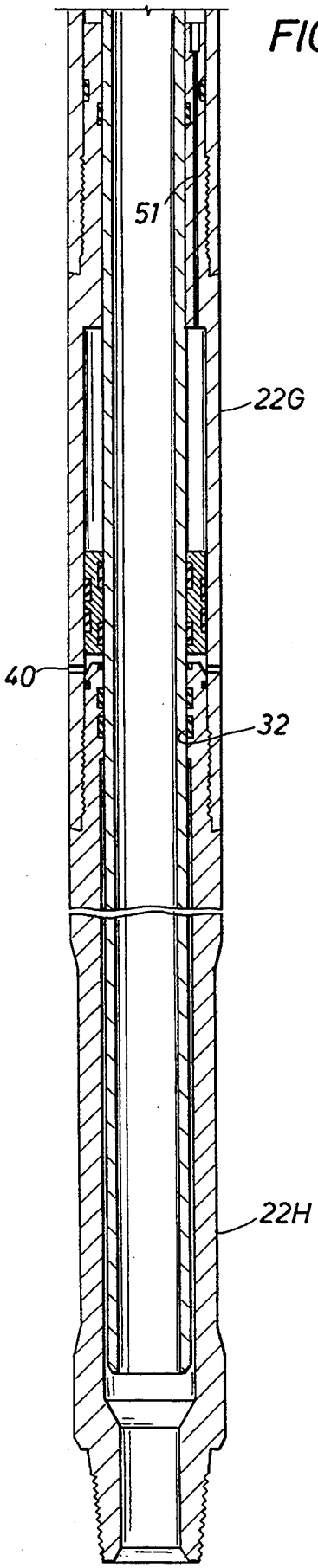

As also shown in one embodiment of the jar of U.S. Pat. No. 5,174,393, each detent means comprises a detent ring 47 closely slidable about a reduced outer diameter portion 48 of the inner tubular member intermediate downwardly and upwardly facing shoulders 48A and 48B, which are spaced apart a distance to permit the detent ring to reciprocate with respect to the inner tubular member. Particularly, slots 48C are formed longitudinally in the reduced outer diameter portion in the inner tubular member to connect at their upper ends with the reduced diameter portions when the detent rings are in their lower positions, as shown in FIGS. 1D, 1F and 1H, and to connect at their lower ends with the reduced diameter portions when the detent rings are in their positions. Additionally, one or more metering pins 52 extend closely through passageways 53 formed through each of the detent rings to engage at their opposite ends with the upper and lower shoulders about the inner tubular member to limit flow past the detent rings.

More particularly, the outer diameter of each detent ring is adapted to fit closely in its respective restriction and has several holes 54 formed therethrough to connect its inner and outer diameters during all positions of the detent ring vertically with respect to the inner tubular member. Consequently, in the event the jar is to be moved upwardly, the detent ring will initially seat upon shoulder 48B, and, as the upper annular portion of the detent ring above the holes 54 moves into the restriction, hydraulic fluid will be free to pass into the upper ends of the slots and out the holes, even though the lower end of the ring is seated upon the lower shoulder. Thus, each detent ring moves relatively freely into the restriction until the upper end of the lower annular portion thereof below holes 54 begins to move into the restriction, at which time the operator is able to detect the beginning of the jarring stroke by observing the weight indicator at the well surface. In the event a full upward jar is to be imposed, the inner tubular member continues to be raised, following which movement of the detent rings out of the restrictions permits tension on the inner tubular member to impart an upward jar.

Conversely, in the event the jar is to be moved downwardly, each detent ring will initially seat upon shoulder 48A, and, as the lower annular portion of the detent ring below the holes 54 moves into the restriction, hydraulic fluid will be free to pass into the lower ends of the slots and out the holes, even though the upper end of the ring is seated upon the upper shoulder. Thus, each detent ring moves freely into the restriction until the lower end of the lower annular portion thereof begins to move into the restriction, at which time the operator is able to detect the beginning of the jarring stroke. In the event a full downward jar is to be imposed, the inner tubular member continues to be raised, following which movement of the detent rings out of the restrictions permits compression on the inner tubular member to impart an upward jar.

As fully described in U.S. Pat. No. 5,174,393, if it is desired to impart another downward jar, the inner tubular member may be moved upwardly to "short-cock" the jar in preparation for a subsequent downward jar. Thus, during initial upward movement of the inner tubular member for this purpose, the detent rings have moved relatively freely through the restrictions due to the passage of hydraulic fluid through the holes 54 and the upper ends of the slots past the upper end of the detent ring which is spaced below the upper shoulders. Obviously, a reversal of this procedure permits the inner tubular member to be moved downwardly to "short-cock" the jar in preparation for a subsequent up jar.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations.

This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A hydraulic jar for use in applying up and down jars to an object stuck in a well bore, comprising;

first and second telescopically arranged tubular members connectible, respectively, to the stuck object and a pipe string adapted to be raised and lowered within the well bore and having an annular space between them, means within the annular space sealing between vertically upper, lower and intermediate equal diameter portions of the tubular members, an upper piston ring sealably slidable within the annular space between the tubular members vertically intermediate the upper and intermediate sealing means, said upper piston ring having upper and lower ends to form an upper pressure, chamber in the space on one end of said upper piston ring which is adapted to be filled with hydraulic fluid, a lower piston ring beneath the upper piston ring sealably slidable with the annular space between the tubular members vertically intermediate the lower and intermediate sealing means, said lower piston ring having upper and lower ends to form a lower pressure chamber beneath upper pressure chamber in the space on one end of said lower piston ring which is adapted to be filled with hydraulic fluid, the outer tubular member having ports connecting its outer side with the annular space on the other ends of the piston rings, the first tubular member having an upper cylindrical restriction in the upper pressure chamber and a lower cylindrical restriction in the lower pressure chamber, upper detent means carried by the second tubular member within the upper chamber for movement through the upper restriction so as to restrict the flow of hydraulic fluid within said upper pressure chamber as the second tubular member is raised with the pipe string with respect to the first tubular member and restrict the flow of such fluid within the upper pressure chamber as the second tubular member is lowered with the pipe string with respect to the first tubular member, lower detent means carried by the second tubular member beneath the upper detent means within the lower chamber so as to restrict the flow of hydraulic fluid within said lower pressure chamber simultaneously with the restriction of flow in said upper chamber as the second tubular member is raised with the pipe string with respect to the first tubular member and restrict the flow of such fluid within the lower pressure chamber simultaneously with the restriction of flow in said upper chamber as the second tubular member is lowered with the pipe string with respect to said first tubular member, shoulder means on said tubular members for engaging one another to impart an up jar to the object as the upper and lower detent means are raised upwardly out of the restrictions and for engaging one another to impart a down jar to the object as said upper and lower detent means are lowered through the restrictions.

2. A jar of the character defined in claim 1, wherein the upper and lower detent means includes means by which, following an up jar, they may be moved downward into the restrictions preparatory to imparting another up jar, without restricting relatively free flow therepast in the opposite direction and following a down jar, they may be moved upwardly into the restrictions preparatory to imparting another down jar, without restricting relatively free flow therepast in the opposite direction.

3. A jar of the character defined in claim 2, wherein the second tubular member has upper and lower shoulders and upper and lower sets of longitudinal grooves formed about its circumference intermediate the upper and lower shoulders, respectively and each of the upper and lower detent means comprises detent ring means having one side disposed closely about the upper and lower sets of grooves, respectively, each detent ring means having upper and lower annular portions and being vertically reciprocable with respect to said second member between a first position in which its lower end is seated on a lower shoulder of the second member to prevent flow therepast, as the lower annular portion of its other side is pulled upwardly through the restriction, and a second position in which its upper end is seated on the upper shoulder of said second member to prevent flow therepast, as the upper annular portion of its other side is pushed downwardly through the restriction, metering means within the detent ring means which permit limited flow therethrough as said annular portions move through said restriction, and means connecting one side of each metering means with its other side intermediate said annular portions so that the annular portion last to move out of the restriction is relatively freely movable back into the restriction until the other annular portion enters the restriction.

4. A hydraulic jar of the character defined in claim 3, wherein the detent ring means comprises a single detent ring having passageway means therein connecting the one side with the outer side thereof vertically intermediate said annular portions.

5. A hydraulic jar of the character defined in claim 4, wherein the passageway means comprises a hole extending through the detent ring to connect its opposite sides.

6. A hydraulic jar of the character defined in claim 1, wherein the cylindrical restrictions are on the inner diameter of the outer member, and the detent ring means are carried by the inner member.

7. A jar of the character defined in claim 3, including means for adjusting the vertical positions of the shoulders of at least one of the detent ring means with respect to the length of the second tubular member.

* * * * *

UNITED STATES PATENT AND TRADEMARK OFFICE

CERTIFICATE OF CORRECTION

PATENT NO. : 5,447,196

DATED : September 5, 1996

INVENTOR(S) : Billy J. Roberts

It is certified that error appears in the above-indentified patent and that said Letters Patent is hereby corrected as shown below:

Col. 4, line 7, before "chamber" insert --upper--;
line 10, before "chamber" insert --upper--;
line 10, change "raised" to --lowered--;
line 11, before "respect" insert --with--;
line 15, before "chamber" insert --lower--;
line 17, change "lowered" to --raised--;
line 19, before "chamber" insert --lower--;
line 19, change "restrict the" to --restriction of--.

Signed and Sealed this

Eighth Day of July, 1997

Bruce Lehman

*Attest:*

BRUCE LEHMAN

*Attesting Officer*

*Commissioner of Patents and Trademarks*